US009120193B2

(12) United States Patent
Wan et al.

(10) Patent No.: US 9,120,193 B2
(45) Date of Patent: Sep. 1, 2015

(54) APPARATUS AND METHOD FOR POLISHING AN EDGE OF AN ARTICLE USING MAGNETORHEOLOGICAL (MR) FLUID

(75) Inventors: Yee Ming Stephen Wan, Singapore (SG); Takashi Sato, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 122 days.

(21) Appl. No.: 13/885,679

(22) PCT Filed: Nov. 15, 2011

(86) PCT No.: PCT/SG2011/000405

§ 371 (c)(1),
(2), (4) Date: May 15, 2013

(87) PCT Pub. No.: WO2012/067587

PCT Pub. Date: May 24, 2012

(65) Prior Publication Data

US 2013/0260651 A1 Oct. 3, 2013

(30) Foreign Application Priority Data

Nov. 15, 2010 (SG) ..... 201008438-2

(51) Int. Cl.
*B24B 9/08* (2006.01)
*B24B 1/00* (2006.01)
(Continued)

(52) U.S. Cl.
CPC ..... *B24B 1/005* (2013.01); *B24B 9/102* (2013.01); *B24B 35/00* (2013.01)

(58) Field of Classification Search
CPC ..... B24B 9/00; B24B 9/14; B24B 9/148; B24B 13/005; B24B 9/146; B24B 49/02
USPC ..... 451/36, 37, 43, 296, 446, 113, 106, 74
See application file for complete search history.

(56) References Cited

U.S. PATENT DOCUMENTS 5,616,066 A 4/1997 Jacobs et al.
5,839,944 A * 11/1998 Jacobs et al. ..... 451/8
5,951,369 A * 9/1999 Kordonski et al. ..... 451/5
(Continued)

FOREIGN PATENT DOCUMENTS

EP 1 060 833 A1 12/2000

OTHER PUBLICATIONS

PCT International Search Report for PCT Counterpart Application No. PCT/SG2011/000405, 3 pages, (Feb. 28, 2012).
(Continued)

*Primary Examiner* — George Nguyen
(74) *Attorney, Agent, or Firm* — Blakely, Sokoloff, Taylor & Zafman LLP

(57) ABSTRACT

Disclosed is a method and apparatus for polishing an edge of an article involving providing at least one carrier including: first and second opposing surfaces defining a groove, the first and second opposing surfaces being spaced apart in a first direction to receive the edge; and magnetic field generator configured to provide a magnetic field in the groove to stiffen magnetorheological (MR) fluid disposed in the groove to provide at least one polishing zone; receiving the edge in the polishing zone; and driving relative motion between the at least one carrier and the edge in a second direction substantially transverse to the first direction.

19 Claims, 10 Drawing Sheets

(51) Int. Cl.
*B24B 35/00* (2006.01)
*B24B 9/10* (2006.01)

(56) References Cited

U.S. PATENT DOCUMENTS

| | | | | |
|---|---|---|---|---|
| 5,971,835 | A * | 10/1999 | Kordonski et al. | 451/38 |
| 6,893,322 | B2 * | 5/2005 | Kordonski et al. | 451/5 |
| 7,156,724 | B2 * | 1/2007 | Kordonski et al. | 451/113 |
| 2001/0029149 | A1 * | 10/2001 | Kordonski et al. | 451/36 |
| 2002/0081943 | A1 | 6/2002 | Hendron et al. | |
| 2004/0029493 | A1 * | 2/2004 | Tricard et al. | 451/36 |
| 2006/0252354 | A1 * | 11/2006 | Arana et al. | 451/28 |
| 2011/0244759 | A1 * | 10/2011 | Sutton | 451/5 |
| 2011/0275286 | A1 * | 11/2011 | Menapace et al. | 451/41 |

OTHER PUBLICATIONS

PCT Written Opinion of the International Searching Authority for PCT Counterpart Application No. PCT/SG2011/000405, 4 pages, (Feb. 28, 2012).

PCT International Preliminary Report on Patentability (Chapter II of the Patent Cooperation Treaty) for PCT Counterpart Application No. PCT/SG2011/000405, 3 pages, (Sep. 6, 2012).

* cited by examiner

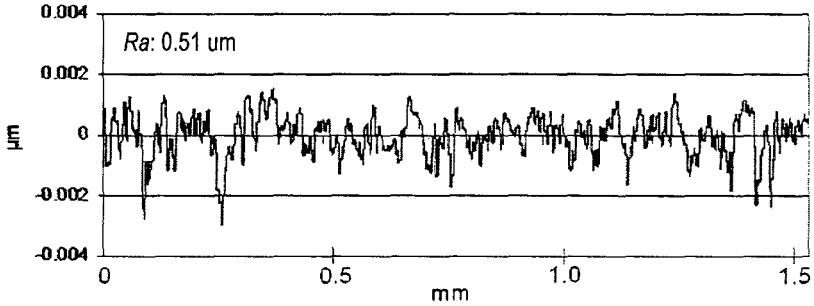
Figure 5(a)(i) Unpolished surface (Ground surface)
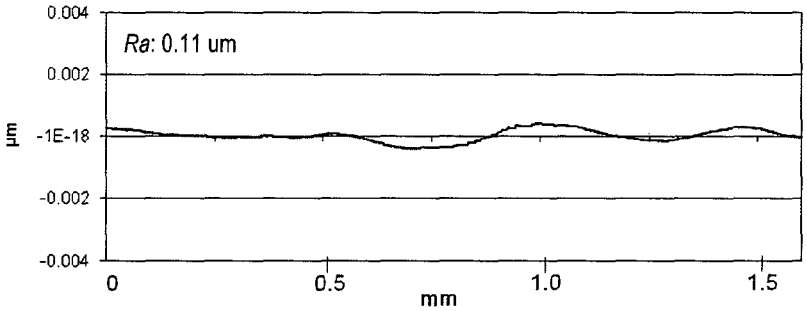
Figure 5(a)(ii) Surface polished by a single magnet
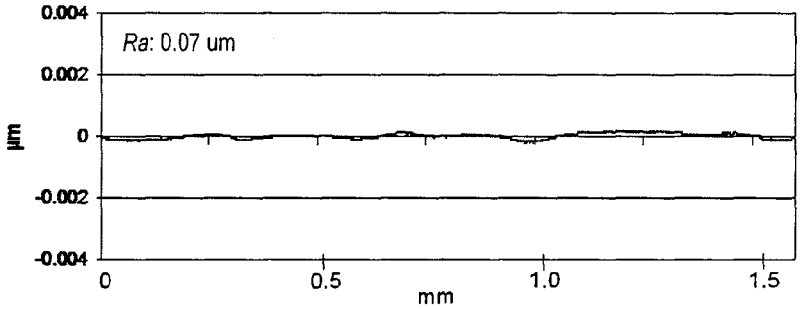
Figure 5(a)(iii) Surface polished by a pair magnets
Figure 5a: Comparison of unpolished and polished surface (surface roughness profile)

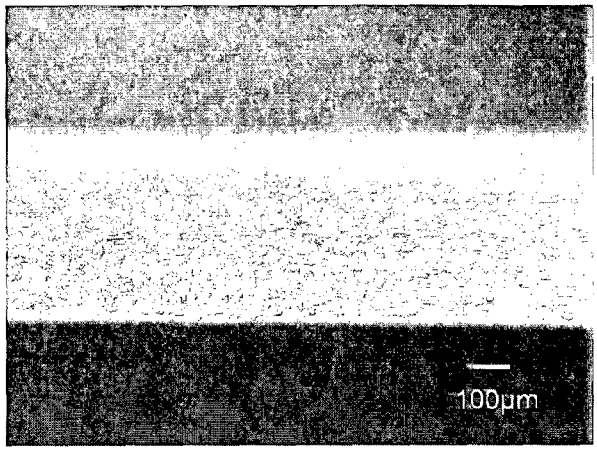
Figure 5(b)(i) Unpolished surface (Ground surface)
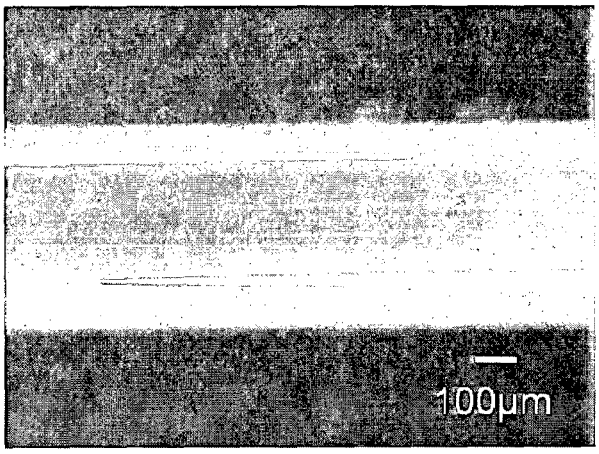
Figure 5(b)(ii) Surface polished by a single magnet
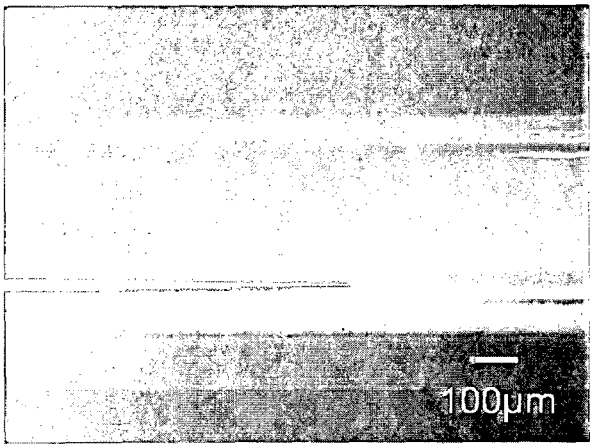
Figure 5(b)(iii) Surface polished by a pair magnets
Figure 5b: Comparison of unpolished and polished surface (photo of surface)

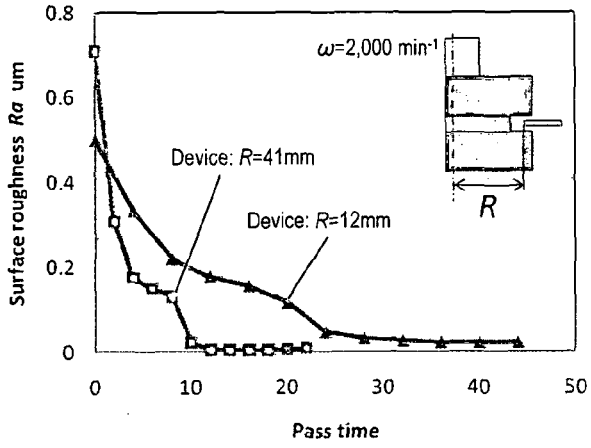
Figure 6: Comparison in variation of surface roughness with pass time polished by different *R* device
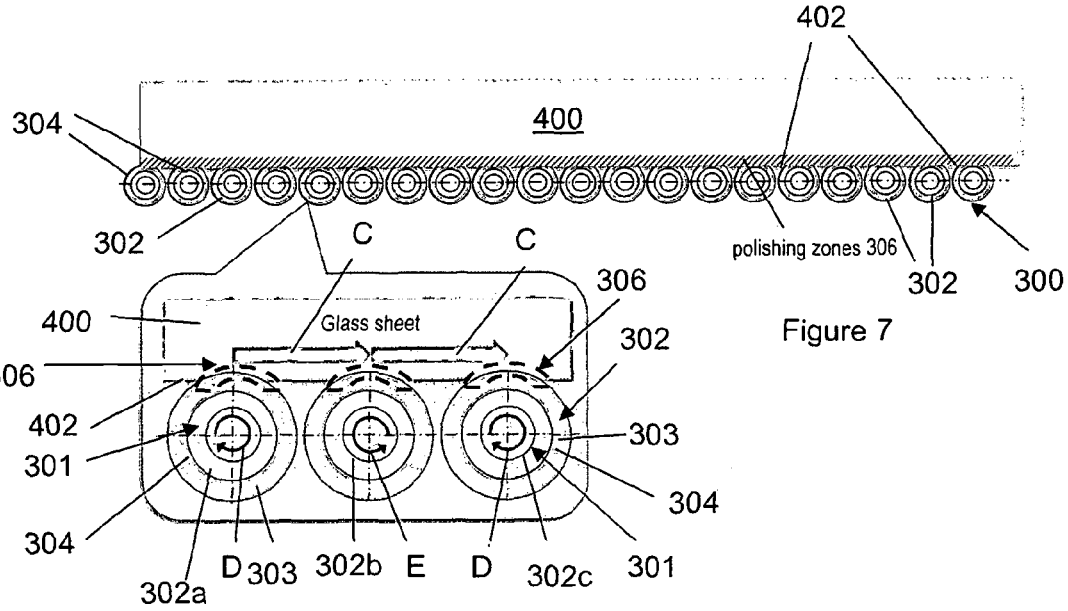
Figure 7
Figure 8

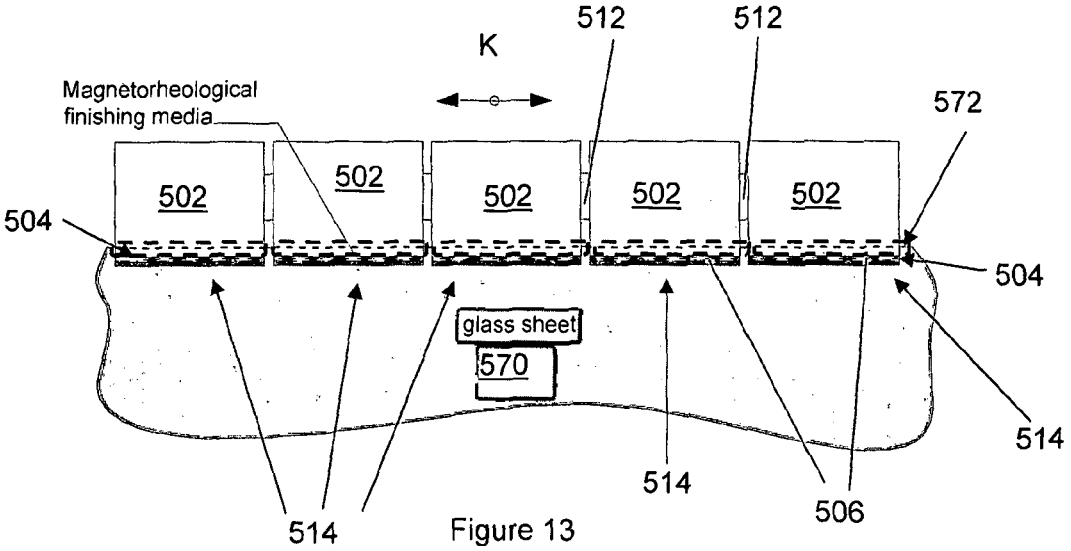
Figure 13
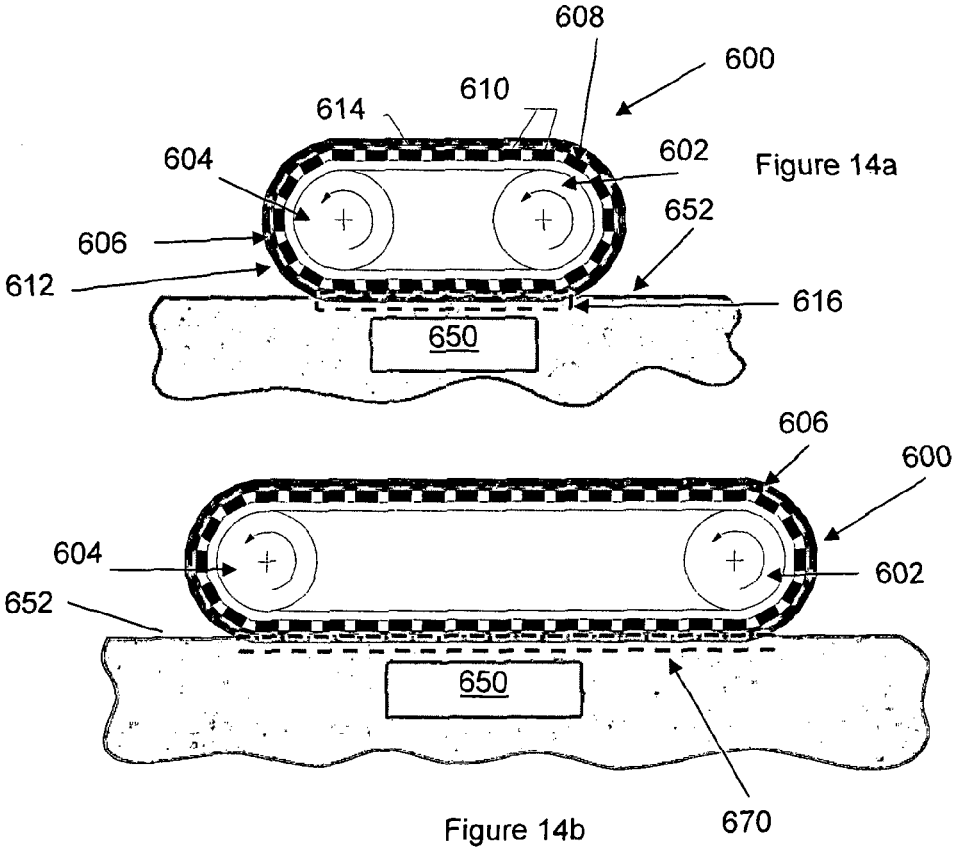
Figure 14a
Figure 14b

APPARATUS AND METHOD FOR POLISHING AN EDGE OF AN ARTICLE USING MAGNETORHEOLOGICAL (MR) FLUID

CROSS-REFERENCE TO RELATED APPLICATIONS

This patent application is a U.S. National Phase Application under 35 U.S.C. §371 of International Application No. PCT/SG2011/000405, filed Nov. 15, 2011, entitled APPARATUS AND METHOD FOR POLISHING AN EDGE OF AN ARTICLE USING MAGNETORHEOLOGICAL (MR) FLUID, which claims priority to Singapore Patent Application No. 201008438-2, filed Nov. 15, 2010.

FIELD

This invention relates to an apparatus and method for polishing an edge of an article using magnetorheological fluid, more particularly but not exclusively, for polishing the edges of large glass panels.

BACKGROUND

It is known to use magnetorheological finishing (MRF) uses magnetorheological (MR) fluid to polish or remove materials from surfaces of optical lens. The MR fluids include suspensions of ferro-magnetic particles carried by a carrier fluid. Under influence of a magnetic field, the ferro-magnetic particles are magnetized by the magnetic field and viscosity of the MR fluid changes almost instantaneously from a liquid state to a semi-solid state which is still sufficiently pliant to conform to a surface of a workpiece being polished. However, for certain applications, such as removal of sub-surface damage including sub-surface micro-crack, current MRF techniques do not yield sufficiently useful material removal rates for required production yields. Commercially available glass polishing disks are also not suitable for removing sub-surface micro-cracks.

There is therefore a need to provide an apparatus and method for polishing an edge of an article using magnetorheological fluid to address at least one of the disadvantages of the prior art and/or to provide the public with a useful choice.

SUMMARY

In accordance with a first aspect, there is provided an apparatus for polishing an edge of an article using a magnetorheological (MR) fluid, the apparatus including at least one carrier including first and second opposing surfaces defining a groove, the first and second opposing surfaces being spaced apart along a first direction to receive the edge; and a magnetic field generator configured to provide a magnetic field in the groove, wherein in operation the MR fluid is disposed in the groove and stiffens in response to the magnetic field to provide at least one polishing zone; and a driver configured to provide relative motion between the at least one carrier and the edge of the article in a second direction substantially transverse to the first direction for polishing the edge of the article in the at least one polishing zone.

The magnetic field generator may further include first and second permanent magnets providing the first and second opposing surfaces respectively. The magnetic field generator can be configured to provide the magnetic field throughout the groove such that the MR fluid is stiffened throughout the groove.

The groove can be configured to retain substantially all of the MR fluid disposed therein. The groove can be annular, the groove being characterised by an axis of rotational symmetry parallel to the first direction. The groove may extend substantially parallel to the second direction.

The apparatus can be configured such that the relative motion further includes a reciprocating motion. The relative motion may include rotational motion of the at least one carrier.

The apparatus may include a plurality of the carriers aligned substantially parallel to the second direction to simultaneously provide at least one polishing zone. The apparatus may be configured such that each one of the at least one carrier is rotatable about an axis parallel to the first direction. Immediately adjacent ones of the carriers are rotatable in different directions.

Optionally, the apparatus may include a restoring tool configured to shape the MR fluid.

The at least one carrier may further include a conveyor configured to provide the first and second opposing surfaces, the conveyor being operable by the driver. The magnetic generator may include a plurality of magnets arranged equidistantly along the conveyor. The apparatus can further include a moisturizing device configured to moisturize the MR fluid.

In another aspect, there is provided a method for polishing an edge of an article, the method comprising: providing at least one carrier including: first and second opposing surfaces defining a groove, the first and second opposing surfaces being spaced apart in a first direction to receive the edge; and a magnetic field generator configured to provide a magnetic field in the groove to stiffen magnetorheological (MR) fluid disposed in the groove to provide at least one polishing zone; receiving the edge in the polishing zone; and driving relative motion between the at least one carrier and the edge in a second direction substantially transverse to the first direction.

The method may include stiffening the MR fluid throughout the groove. The method may further include retaining substantially all of the MR fluid disposed in the groove. The method may include simultaneously receiving different parts of the edge in the groove. The method may further include rotating immediately adjacent ones of the carriers in different directions.

An advantage of the described embodiment is that with the plurality of polishing zones to polish different portions of the linear surface simultaneously, polishing time may be reduced and material removal rate may also be increased.

With an elongate polishing zone, a much quicker polishing time of the linear surface may be achieved.

With the pair of magnetic field generators, the generators generate respective magnetic fields which compliment each other to generate a combined magnetic field of greater intensity. In this way, a much quicker grinding or polishing is achieved.

BRIEF DESCRIPTION OF THE DRAWINGS

Examples of the invention will now be described with reference to the accompanying drawings, in which:

FIGS. 5*a*(*i*) to (*iii*) and 5*b*(*i*) to (*iii*) show a series of surface roughness profiles and magnified photographs respectively to compare between unpolished and polished surfaces using the arrangements of FIGS. 1 and 3;

FIG. 6 is a graph illustrating effects of different radius values of cylindrical housing of FIG. 1 on surface roughness of a surface to be polished;

FIG. 7 shows the apparatus according to one embodiment having a plurality of carriers arranged in an end-to-end relationship with each other to polish a glass edge;

FIG. 8 is an enlarged view of a portion of FIG. 7 which shows three of the carriers and their respective polishing zones;

FIG. 13 illustrates another embodiment which employs a plurality of carriers of FIG. 11;

FIG. 14*a* shows the apparatus according to one embodiment of the apparatus;

FIG. 14*b* shows the apparatus of FIG. 14*a* adapted to provide a longer elongate polishing zone;

DETAILED DESCRIPTION OF PREFERRED EMBODIMENTS

Figure 1:
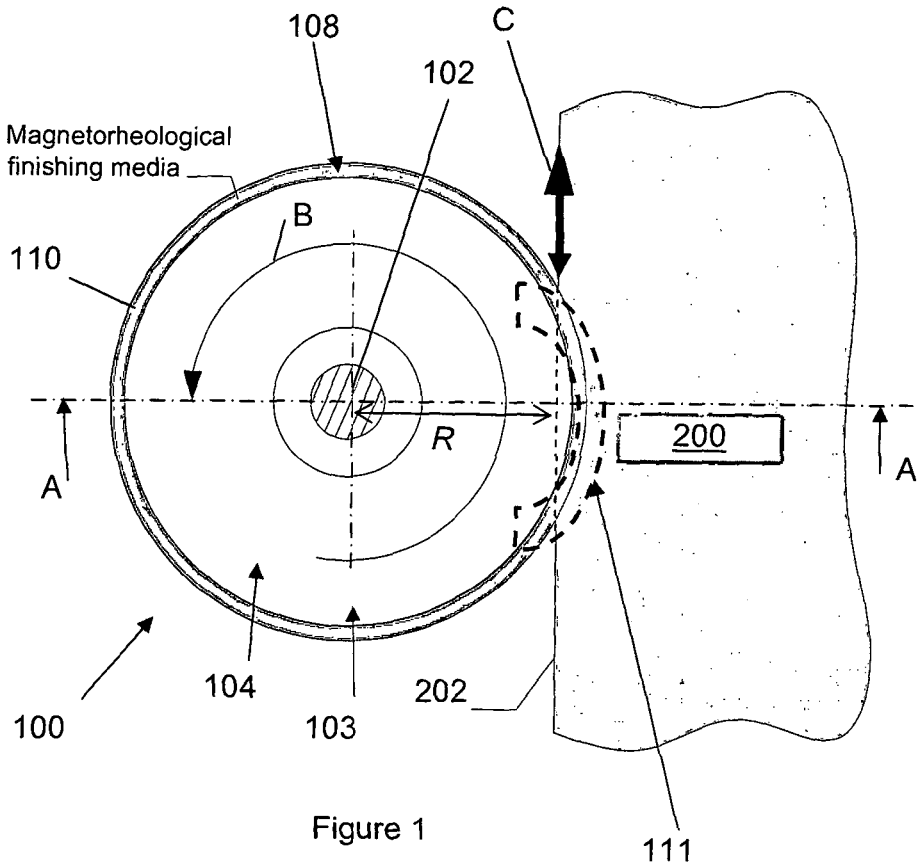
FIG. 1 is a schematic diagram of a top view of an apparatus according to one embodiment.

To appreciate advantages of the embodiments, it would be useful to begin with an explanation of various parameters which may affect material removal rate of a magnetorheological finishing (MRF) process.

It has been found that tribologically, the MRF process is a combination of two and three body abrasive wear. Hence, the following process equations discussed are applicable to the MRF process:

$$R_a = (R_i - R_\infty)\cdot e^{-\frac{k_T p_a v}{H}} + R_\infty \quad (1)$$

$$h = a\cdot(R_i - R_\infty)\cdot\left(1 - e^{-\frac{k_T p_a v}{H}t}\right) + \frac{k_S p_a v}{H}t \quad (2)$$

where $R_a$ is surface roughness achieved in a polishing time, t from an initial surface roughness, $R_i$ of a surface to be polished;

v is the sliding velocity or tangential contact velocity between a MRF abrasive media and the surface being polished;

$R_\infty$ is a limiting surface roughness, or the lowest surface roughness that can be achieved;

$p_a$ is defined as normal force per unit area acting on the surface being polished;

H is hardness of the surface being polished;

$k_T$ and $k_S$ are wear coefficients;

h is wear depth, and a is a geometrical constant.

To obtain the wear coefficients $k_T$ and $k_S$, for the purpose of predicting surface roughness and geometrical change distribution, experiments are carried out on a test strip made of glass.

Estimation of $k_T$

If the area of the test strip I coupon is $A_c$ and force acting on the test strip as measured by a force sensor is $F_c$, the granular pressure, $p_g$ may be estimated as:

$$p_g \approx \frac{F_c}{A_c}$$

With a known tangential velocity, $v_s$, and referring to equation (1), it is possible to estimate $k_T$ from a plot of $$\ln\left(\frac{R_a - R_\infty}{R_i - R_\infty}\right)$$

versus time. Of course, $R_a$ is the surface roughness of the exposed surface of the test strip or coupon as explained earlier.

Estimation of $k_S$

Now for large t, equation (2) reduces to:

$$h = \frac{k_s p_g v_s}{H}t$$

from which $k_s$ may be estimated from a plot of h versus time. Of course, h is the wear depth or change in thickness of the test strip or, coupon Estimation of a From equations (1) and (2), it follows immediately that:

$$\frac{\partial h}{\partial t} = -a\frac{\partial R_a}{\partial t} + \frac{k_s p_g v_s}{H}$$

Thus, a may be estimated from a plot of $$\frac{\partial h}{\partial t} \text{ versus } \frac{\partial R_a}{\partial t}$$

provided data for small t are available.

From equation (2), it can be appreciated that material removal, which is based on wear depth, h, is intertwined with surface roughness evolution. Hence, to increase material removal rate (MMR) and also polishing rate, a consideration is to increase, $\dot{p}_a$, v or the wear coefficients, $k_T$ and $k_S$ or combinations or permutations of these factors. The following descriptions of various embodiments will teach those skilled in the art how to achieve this.

Figure 2:
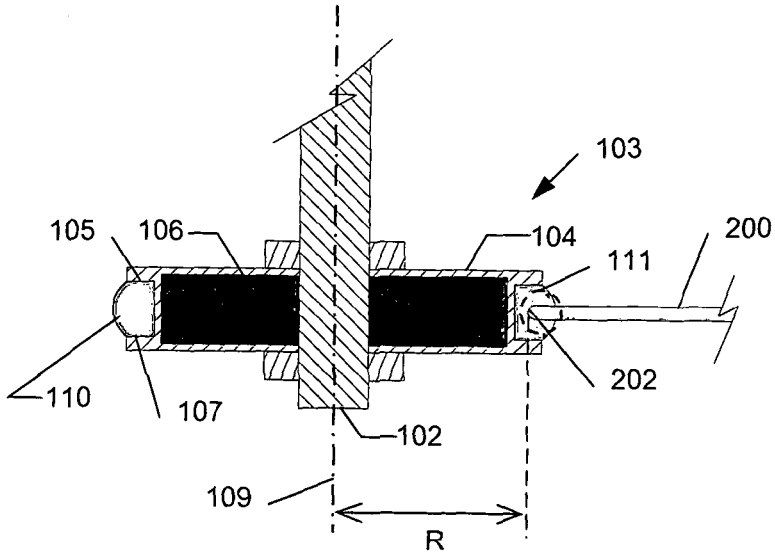
FIG. 2 is a cross-sectional view of the apparatus of FIG. 1 in the direction AA.

FIG. 1 is a schematic diagram of a top view of an apparatus 100 for cleaning or polishing an article 200 using a magnetorheological (MR) fluid, and FIG. 2 is a cross-sectional view of the apparatus 100 of FIG. 1 in the direction AA.

In one embodiment, the apparatus 100 includes a carrier 103 that includes a rotatable central shaft 102, a cylindrical housing 104 coupled to the central shaft 102, and a ring permanent magnet 106 with two poles (N-pole and S-pole) oriented as shown. The shaft 102 is connected to a driver or spindle (not shown) to spin the shaft 102 and the cylindrical housing 104.

The carrier 103 includes a cylindrical housing 104 which houses or encases the ring permanent magnet 106. The cylindrical housing 104 includes a first surface 105 and a second surface 107 with both surfaces opposing each other to define a groove 108. The housing 104 further houses the ring permanent magnet 106 such that the magnetic field extends through the groove 108. The groove 108 may be a circumferential channel or side groove 108 between the top and bottom surfaces 105,107 arranged to contain a MR fluid 110. In this embodiment, the MR fluid 110 comprises ferro-magnetic particles of between 1 and 10 microns suspended in water, as carrier fluid. The concentration of the ferro-magnetic particles is 20-40% by volume. The MR fluid 110 also includes minute quantities of abrasive of about 0.3-1% by volume in the form of Silicon Carbide (SiC) to increase material removal rates of a linear glass surface or edge 202 of the glass 200 to be polished by the MRF apparatus 100. It should be appreciated that other abrasives may be used, for example, Aluminum Oxide, Cerium Oxide or diamonds.

The ring permanent magnet 106 used in this setup is Nd(neodymium)-Fe (ferrite)-B(boron) rare earth permanent magnet to create sufficiently strong magnetic fields to produce an almost instantaneous change of the MR fluid from a liquid state to a semi-solid state throughout the entire side groove 108 and which is still sufficiently pliant to conform to the edge 202 of the article to be polished.

To polish the straight glass edge 202, the spindle is rotated to spin the central shaft 102 and the carrier 103 about a central axis of the central shaft 102 and from FIG. 1, the direction of rotation is shown by arrow B. In this way, the groove 108 of the carrier 103 carries the MR fluid 110 continuously to a polishing zone 111 for polishing a portion of the edge 202 of the article. The polishing zone is defined as a section of the carrier 103 where the MR fluid 110 is in contact with or polishes the glass sheet 200. Since the housing 104 is circular in shape, the polishing zone 111 of FIG. 1 is curved or has an arc-shape. During the rotation, the magnetic field generated by the ring permanent magnet 106 magnetically stiffens the MR fluid 110 particularly at the polishing zone 111 and when the magnetized MR fluid 110 is brought in contact with the glass edge 202, this enables the MR fluid 110 to grind or polish the edge 202 of the article to remove materials on the edge abrasion. Further, linear reciprocal motion (see arrow C) between the carrier 103 and the edge 202 of the article 200 enables the apparatus 100 to polish the entire length of the edge 202 of the article. The linear reciprocal motion may be accomplished by either moving the shaft 102 (and thus the carrier 103) linearly along the entire edge 202 of the article whilst maintaining the position of the article 200 or maintaining the position of the shaft 102 and moving the the article 200.

Figure 3A:
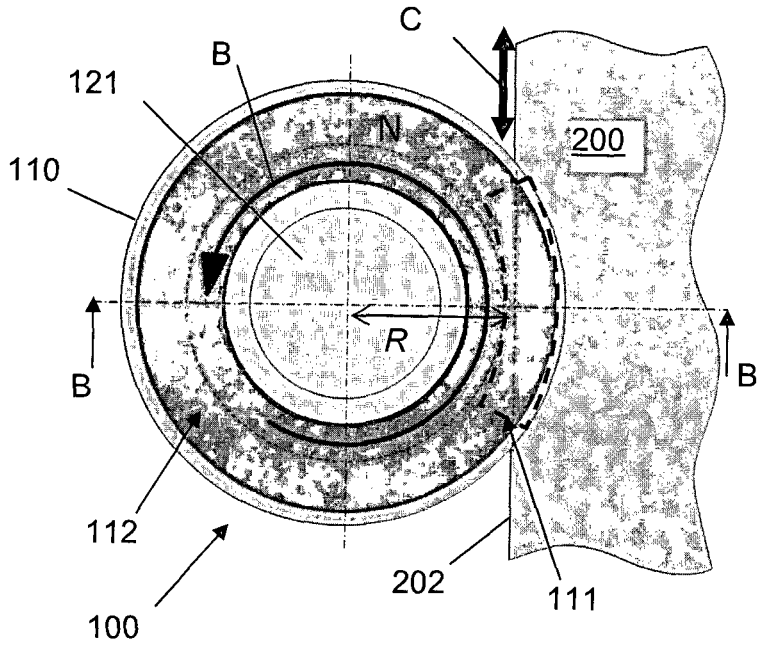
FIG. 3*a* is a schematic diagram of a top view of an apparatus according to another embodiment.
Figure 3B:
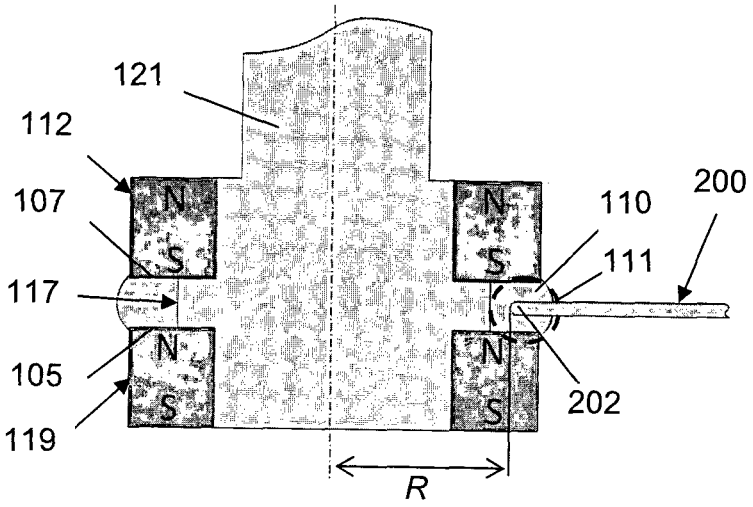
FIG. 3*b* is a cross-sectional view of the apparatus of FIG. 3*a* in the direction BB, which is a first embodiment of the invention having a pair of permanent magnets.

According to another embodiment of the apparatus, instead of having one movable carrier 103 arranged to house the ring permanent magnet 106, the apparatus 100 further includes a pair of permanent magnets 112,119 arranged to a rotatable central shaft 121 as shown in FIGS. 3*a* and 3*b*. The side groove consists of top and bottom surfaces 105, 107 opposing each other and a side wall 117 between the top and bottom surfaces 107,105 as shown in FIG. 3*b* includes a polishing zone 111. As the shaft 121 rotates, the pair of permanent magnets 112,119 rotate together and with the rotation, the side wall 117 is arranged to carry the MR fluid 110 to the polishing zone 111 so that the MR fluid 110 is able to polish the glass edge 202. The pair of ring permanent magnets 112,119 cooperate to magnetically stiffen the MR fluid 110. With the combination of the pair of ring permanent magnets 112,119, this increases intensity of the magnetic field generated by the MRF apparatus 100, leading to quicker polishing of the glass edge 202. It should be appreciated that the shaft 121 may be connected to a driver (not shown) to move the shaft 121 (and thus, the side wall 117 and the pair of magnets 112,119) to grind the entire edge 202 of the article 200.

Figure 4A:
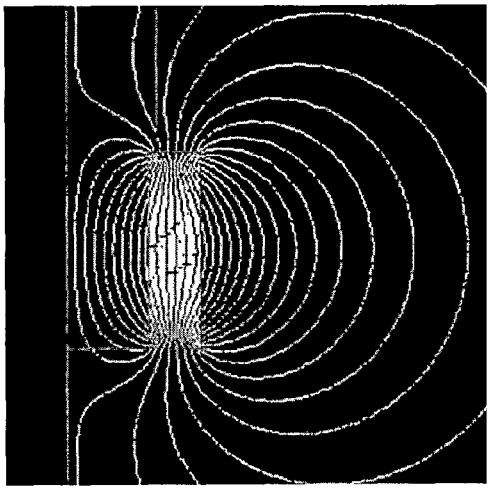
FIG. 4*a* is a simulation result of magnetic flux distribution of a single magnet similar to what would be generated by the apparatus of FIG. 1.
Figure 4B:
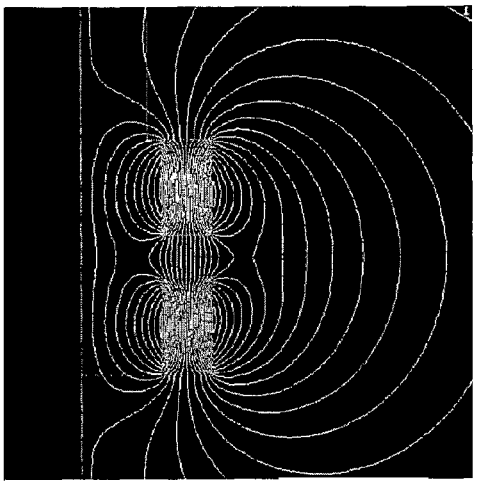
FIG. 4*b* is a simulation result of magnetic flux distribution of a pair of magnets similar to what would be generated by the apparatus of FIG. 3.

FIG. 4*a* illustrates magnetic flux distribution generated by a single ring magnet based on FEM analysis and FIG. 4*b* illustrates magnetic flux distribution by a pair of ring magnets based on FEM analysis and it should be appreciated that the magnetic flux density generated by the pair of ring magnets 112,119 is greater.

With the increase magnetic flux density, this thus increases "media pressure" which is the pressure acting on the MR fluid 110 and the normal stress is increased. In other words, $p_a$, the normal force per unit area is increased. Consequently, the material removal rate is increased.

FIG. 5(*b*)(*i*) is a magnified photograph of a surface to be polished with the corresponding surface roughness profile of Ra: 0.51 μm illustrated in FIG. 5(*a*)(*i*). FIG. 5*b*(*ii*) is a magnified photograph of a part of the surface of FIG. 5*b*(*i*) after being polished by the MRF apparatus 100 having one ring magnet (similar to FIG. 1) after six passes and the corresponding surface roughness profile of the polished surface (the Ra has been reduced to 0.11 μm) is shown in FIG. 5(*a*)(*ii*). FIG. 5*b*(*iii*) is a magnified photograph of another part of the surface of FIG. 5*b*(*i*) after being polished by the MRF apparatus 100 configured with a pair of magnets similar to that in FIG. 3 after six passes with the roughness profile shown in FIG. 5(*a*)(*iii*)(Ra: 0.07 μm). It should be appreciated that the surface after being polished by the pair of magnets is now much smoother compared to one magnet for the same number of passes. In other words, if the same level of smoothness is desired, the MRF apparatus with the pair of magnets would remove materials at a much faster rate than the one with one magnet.

In a second embodiment, the MRF apparatus 100 of FIGS. 1 and 201 of FIG. 3*a* is adapted to increase the tangential contact velocity, v. It has been found that:

$$v=\omega\cdot R=2\pi\theta\cdot R \tag{3}$$

where

- R is radius of the movable carrier as defined by distance from the centre of the shaft to the edge 202 of the article 200 to be polished (i.e. where the MR fluid polishes the glass edge);
- ω is antigonous speed; and
- θ is revolution of the MRF apparatus 100, specifically the movable carrier.

It can be appreciated that the tangential contact velocity, v, may be increased by either increasing the speed of rotation and/or the radius R of the cylindrical housing.

FIG. 6 is a graph illustrating variations of surface roughness due to different R values of the radius of the carrier, while maintaining the speed of rotation constant at 2000 $min^{-1}$. It can be appreciated that with a lager radius or size (R=41 mm), a much faster material removal rate is achieved compared to one with a smaller radius (R=12 mm) since the length of the polishing zone would be increased.

In yet another embodiment, the apparatus 100 of FIG. 1 is adapted to increase contact length between the MR fluid 110 and the glass edge 202 to increase the material removal rate.

FIG. 7 is a top view of an apparatus 300 having a plurality of movable carriers 302 arranged in an end-to-end relationship with each other and to simultaneously polish different parts of an edge 402 of an article 400 such as a sheet of glass. Each of the carriers 302 may be structurally similar to the carrier 103 described above, and includes at least one permanent magnet (not shown) arranged to magnetically stiffen to MR fluid 304 carried by the carrier 302 at a respective curved polishing zone 306.

FIG. 8 is an enlarged view of a portion of FIG. 7 which shows three of the carriers 302*a*,302*b*,302*c* and each carrier includes opposing surfaces 301 (only one of the opposing surface is shown in FIG. 8) and groove 303 between the opposing surfaces for carrying MR fluid. The grooves 303 have respective polishing zones 306 to polish different parts of the edge 402 of the article 400 simultaneously. To polish the entire length of the edge 402 of the article 400, the plurality of carriers 302 and the article 402 are moved relative to one another, and it should be appreciated that only a short traverse length or reciprocating distance needs to be travelled between each movable carrier 302 and the glass sheet 400. The traverse length is shown in FIG. 8 using arrows C which can be a distance between centers of two immediately adjacent carriers 302. In other words, operating a plurality of such carriers 302 effectively increases the contact length between the MR fluid 304 and the edge 402 since multiple polishing zones 306 are created at the same time. In this way, the contact length is increased and the material from the entire length of the edge 402 may be removed at a much faster rate.

It should be appreciated that the leftmost carrier 302*a* of FIG. 8 is arranged to rotate in a same direction as the rightmost carrier 302*c* (i.e. as shown by arrow D) whereas the centre carrier 302*b* between these two carriers 302*a*,302*c* is configured to rotate in an opposite direction as shown by arrow E. In other words, every alternate carrier 302*a*,302*c* rotates in the same direction but two carriers 302*a*,302*b* (or 302*b*,302*c*) immediately adjacent to each other rotate in opposite directions.

Figure 9:
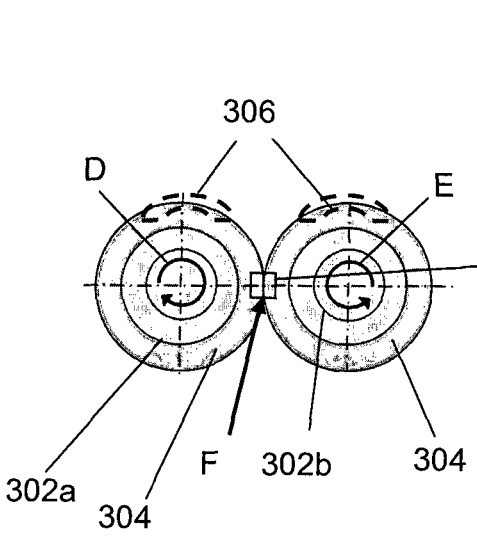
FIG. 9 shows two of the carriers of FIG. 8 which are immediately adjacent to each other and illustrating that they are rotating in different directions.
Figure 10:
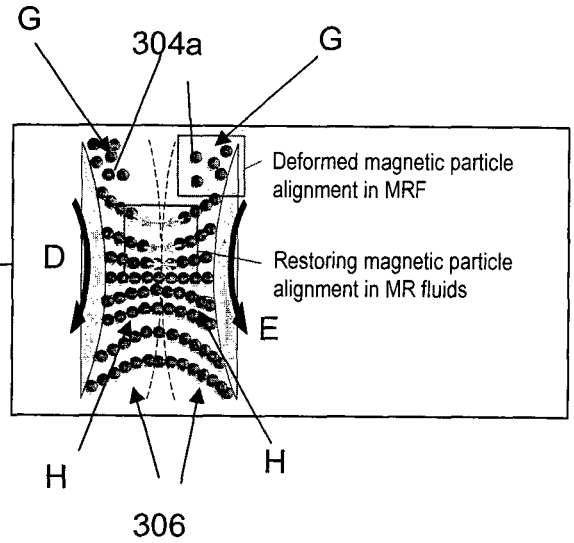
FIG. 10 is a magnified view of region F of FIG. 9 to illustrate effects of rotating the two movable carriers in different directions.

FIG. 9 shows the leftmost carrier 302*a* and the centre carrier 302*b* of FIG. 8 and FIG. 10 is a magnified view of region F of FIG. 9. The magnified view of FIG. 10 illustrates ferro-magnetic particles 304*a* of the MR fluid 304 and at regions G, the ferro-magnetic particles of the respective carriers 302*a*,302*b* just completed polishing of the glass sheet 400 at the respective polishing zones 306 and thus, their alignment are deformed or the particles 304*a* are misaligned. As the leftmost carrier 302*a* rotates in direction D and the centre carrier 302*b* rotates in direction E, this carries the particles to regions H and the close proximity between the two carriers 302*a*,302*b* allows the particles from respective carriers to be magnetically attracted to each other and thus, the particles are aligned along the magnetic flux again for the next polishing and the shape of the MR fluid 304 is restored continuously. In should be appreciated that this is achieved by the magnets of the adjacent carriers 302*a*,302*b* being aligned in opposite polarities which generates a magnetic flux bridge between the adjacent magnets which aligns the particles when they are within the bridge.

Figure 11:
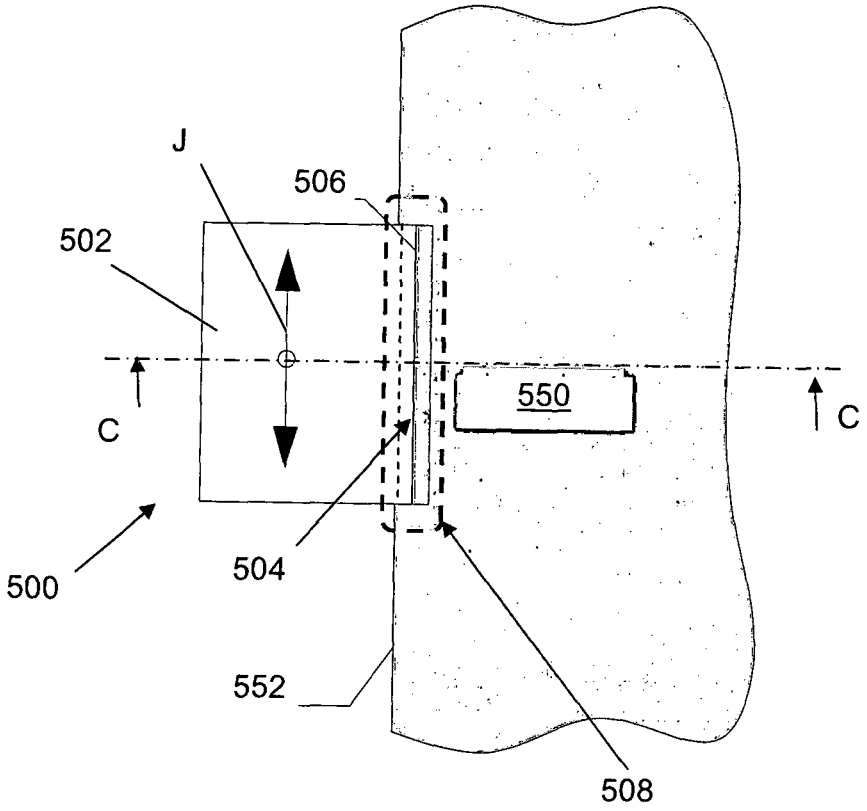
FIG. 11 illustrates another embodiment of the apparatus for increasing the contact velocity of the apparatus.
Figure 12:
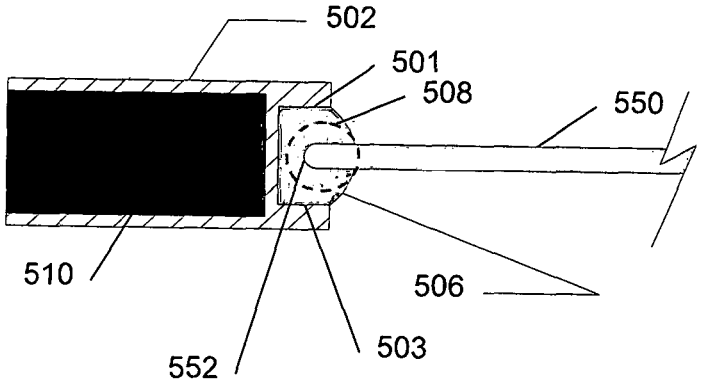
FIG. 12 is a cross-section view of FIG. 11 in the direction CC.

FIG. 11 illustrates one embodiment which is suited to improve the polishing efficiency by providing an elongate polishing zone. FIG. 11 shows a shematic top view of an apparatus 500 having a rectangular carrier 502 (or one having a rectangular cross-section) having a first surface 501 and a second opposing surface 503 (see FIG. 12) defining an elongate channel or groove 504 for carrying MR fluid 506, and FIG. 12 is a cross-section view of FIG. 11 in the direction CC. The elongate channel 504 thus creates an elongate polishing zone 508 for polishing an edge 552 of an article 550 such as a glass panel. The elongate polishing zone 508 is able to polish a longer length of a surface to be polished than the curved polishing zone of the earlier embodiments. The carrier 502 includes a permanent magnet 510 located adjacent the groove for magnetizing the MR fluid 506 along the elongate polishing zone 508. The apparatus 500 further includes a driver (not shown) for reciprocating the position of the carrier 502 with respect to the article 550 (and it should be appreciated that relative motion may be achieved the other way round too i.e. moving the article 550 instead of the carrier 502). In other words, relative motion between the carrier 502 and the article is achieved by sliding the movable carrier 502 linearly as shown by arrow J. In this case, contact velocity, v may be increased by oscillating in J direction at higher frequencies, say by connecting the device to any such suitable means, such a pneumatic linear oscillator or a reciprocating cylinder. To see this, we note that, for a sinusoidal oscillation of frequency, f, the contact velocity is given by:

$$v=2d_0\pi f\cdot\cos(2\pi ft) \tag{4}$$

where, v is contact velocity;

f is oscillation or reciprocating frequency of the movable carrier;

$d_o$ is displacement amplitude of the movable carrier; and t is variable time.

In other words, increasing the oscillation frequency, f, increases the contact velocity, v, and thus, the material removal rate. It should be appreciated that increasing the contact velocity, v, may also be applicable for the embodiments of FIGS. 3 and 8, and indeed, other embodiments in this application.

It has been found that reciprocating displacement of the carrier 502, d, is related to the displacement amplitude based on the following equation:

$$d=d_0\cdot\sin(2\pi ft) \tag{5}$$

Displacement amplitude is defined as a maximum distance that the movable carrier moves from a starting (or zero) position about which the carrier reciprocates or oscillates. As it can be appreciated from Equation (5), to reduce the polishing time, a longer permanent magnet may be used for the movable carrier 502 which results in a greater contact length since a greater polishing zone is created.

Another embodiment of the apparatus employs a plurality of the rectangular carrier 502 and this is shown in FIG. 13. Each carrier 502 is arranged in an end-to-end and spaced apart relationship, and coupled to each other via a movable connection member 512 so that the movable carriers 502 are arranged linearly in a belt arrangement. In this way, the grooves 504 of the movable carriers 502 are arranged to carry MR fluid 506 to corresponding elongate polishing zones 514 for polishing different parts of an edge 572 of an article 570 at the same time. The relative movement between the carriers 502 and the article is accomplished by reciprocating the connection member 512 as shown by arrow K as the magnetized MR fluid 506 polishes the edge 572 while maintaining the position of the article 570. It should be apparent that the same effect may be achieved by doing the opposite, just like the other embodiments, which is to move the position of the article 570 while maintaining the position of the carriers 502.

With the plurality of carriers 502 polishing the edge 572 simultaneously at the respective polishing zones 514, the polishing time may be drastically reduced to obtain a required finish. Further, the reciprocating frequency, f, of the carriers may be selected to further increase the material removal rate as suggested earlier.

FIG. 14*a* shows a top view of an apparatus 600 according to yet another embodiment of the apparatus. The apparatus 600 includes carrier 601 having opposing surfaces (not shown) which define a groove suitable for receiving the edge 652 of the article 650 to be polished. The carrier 606 is in the form of an endless conveyor for carrying MR fluid 614 and the conveyor 606 is driven by a driver that may be a gear arrangement comprising first and second gears 602,604 spaced apart from each other. The carrier 606 includes an inner channel 608 for storing a plurality of permanent magnets 610 arranged equidistantly throughout the conveyor 606. The plurality of permanent magnets 610 are arranged to stiffen the MR fluid 614 magnetically at their corresponding positions and indeed, throughout the entire length of the conveyor 606. The distance between the first and second gears 602,604 creates an elongate polishing zone 616 for polishing a linear portion of an edge 652 of an article 650. As the first and second gears 602,604 rotate in a same direction, this drives the conveyor 606 in an endless loop carrying the MR fluid 614 to the elongate polishing zone 616 to polish the edge 652 and then away from the elongate polishing zone 616. The continuous movement of the conveyor 606 thus allows the MR fluid 614 to polish the edge 652 continuously and over a large distance or area.

It should be apparent that the elongate polishing zone 616 may be adjusted depending on the configuration of the endless conveyor 606 so that the elongate polishing zone 616 covers the entire length of the edge 652 to be polished. FIG. 14*b* shows an example of the apparatus 600 adapted with a longer polishing zone 670 compared with that of FIG. 14*a*. This is achieved by lengthening the distance between the two gears 602,604 of the gear arrangement (or adding more gears to the gear arrangement). Thus, it can be appreciated that the apparatus 600 may be adapted to cover the entire length of the glass edge.

Figure 15:
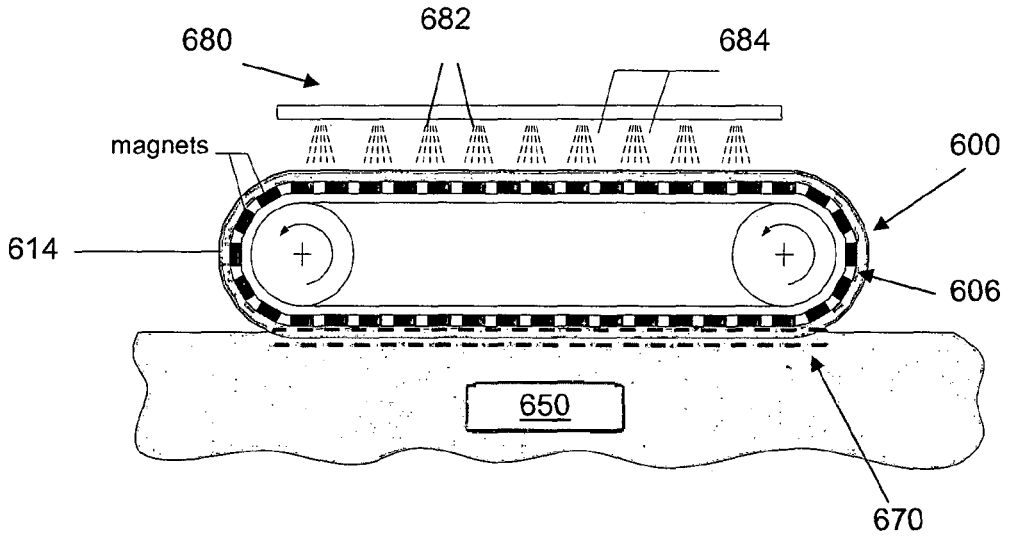
FIG. 15 shows the apparatus of FIG. 14*b* having a moisturizing device for moisturizing the MR fluid.

Optionally, the apparatus 600 further includes a moisturizing device 680 for maintaining moisture content of the MR fluid 614 during the polishing process, and this is illustrated in FIG. 15. The moisturizing device 680 can include at least one nozzle 682 arranged for spraying atomized water mist 684 onto the MR fluid 614 when the MR fluid 614 is rotated by the conveyor carrier 606 out of the polishing zone 670. In this way, the MR fluid 614 is kept in a suitable state to be magnetized for polishing the article 650.

As it can be appreciated from the above, increasing the contact length may reduce the polishing time and to increase the material removal rate, the contact velocity, v, may be increased by increasing rate of rotation, w, of the conveyor 606, and/or radius, R, of the first and/or second gears 602,604.

The described embodiments enhance or accelerate MRF material removal rate and reduce the MRF time of profiling or polishing edges or surfaces of materials such as sheets or panels of glass or a non-magnetic material. This may be used to finish profiled glass edges to achieve super-polishing quality surfaces, and finishing of brittle materials to removal of sub-surface damage. In particular, the embodiments are particularly useful for polishing generally straight edges or sides of articles. Specifically, the polishing zones of the described embodiments are substantially where the MR fluid in the groove would interface with the part of the article received in the groove.

Figure 16:
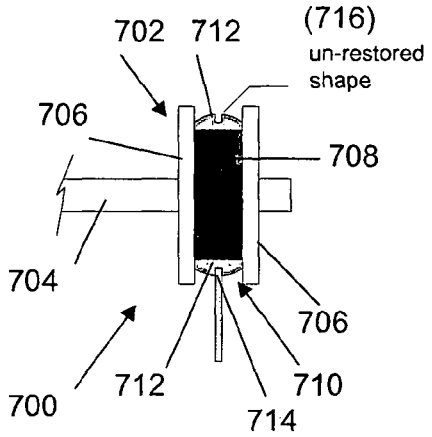
FIG. 16 shows the apparatus for polishing a glass edge using MR fluid to illustrate effects of the polishing on the MR fluid.
Figure 17A:
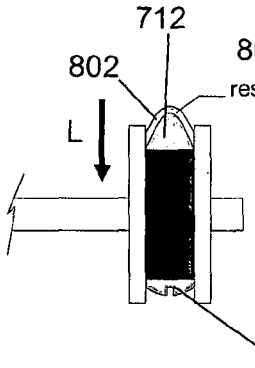
FIGS. 17*a* and 17*b* illustrate a restoring tool for restoring the shape of the MR fluid of FIG. 16.
Figure 17B:
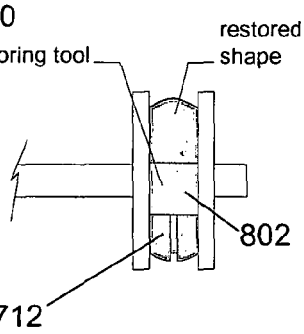

Since the magnetized MR fluid conforms to the surface or edge to be cleaned or polished, over time, the MR fluid may retain the profile of an edge or surface on which the MR fluid is polishing. This effect is illustrated in FIG. 16 which illustrates a schematic side view of an apparatus 700 having a carrier 702 mounted to a driver 704 for rotating the carrier 702. The carrier 702 includes a housing 706 carrying a permanent magnet 708 and providing opposing surfaces defining a groove in the form of a channel 710 for carrying MR fluid 712. Similar to the above embodiments, the driver 704 spins the carrier 702 and the magnetized MR fluid 712 is used to polish a glass edge 714. Over time, the magnetized MR fluid 712 may retain the edge profile 716 of the glass edge 714 and this may diminish the effectiveness of the MR fluid 712 since there is less pressure acting on the glass edge 714. In the embodiment of FIG. 8, the arrangement of the carriers 302 restores the structure of the MR fluid 304 automatically, but for other applications, it may be necessary to use a restoring tool 800 to constrict an un-restored portion (i.e. the edge profile 716) and bring it back to its original shape. FIG. 17*a* shows the apparatus of FIG. 16 being used with the restoring tool 800 and FIG. 17*b* shows the arrangement of FIG. 17*a* in the direction L. In this example, the restoring tool 800 is made of rigid, rust and impact resistant material such as stainless steel, titanium or metal ceramic composites. The restoring tool 800 has a U-shape constrictor 802 and is held stationary in relation to the rotation of the carrier 702 As the magnetized MR fluid 712 passes through the U-shaped constrictor 802 constricts the magnetized MR fluid 712 to conform the shape of the magnetized MR fluid 712 to the shape of the constrictor's inner surface.

Alternatively described, the apparatus 100, 500, 300, 600 is configured for polishing an to edge 202, 402, 552, 652 of an article 200, 400, 550, 570, 650 using a magnetorheological (MR) fluid 110 in which the apparatus includes at least one carrier 103 including first and second opposing surfaces 105, 501, 107, 503 defining a groove 108, 504. While particularly suitable for addressing the unmet need for efficient method and apparatus for polishing glass edges, it would be apparent that the proposed apparatus and method are not limited to the polishing of glass articles. The first and second opposing surfaces are spaced apart along a first direction 109 to receive the edge. It should be appreciated that the edge can be a side surface or a minor surface of the article, where the width of the edge is narrower than the spacing between the first and second opposing surfaces.

The apparatus includes a magnetic field generator 106 configured to provide a magnetic field in the groove, wherein in operation the MR fluid is disposed in the groove and stiffens in response to the magnetic field to provide at least one polishing zone 111. As can be understood from the figures, the polishing zone is where the MR fluid interfaces with the article, which would include the edge to be polished. The shape and size of the polishing zone depends therefore on the shape of the groove and the article, and can substantially be found in the groove. The groove may be characterised by an axis of rotational symmetry parallel to the first direction, or it may extend substantially parallel to the second direction.

The apparatus as described above may include one or, more than one of the carriers, such as shown in FIG. 8, where a plurality of the carriers are aligned substantially parallel to the second direction to simultaneously provide at least one polishing zone to the article. As illustrated, each one of the at least one carrier is rotatable about an axis parallel to the first direction. Immediately adjacent ones of the carriers may be rotatable in different directions. The carrier may take the form of a conveyor, such as an endless conveyor shown in FIG. 14*b*, in which the conveyor provides the first and second opposing surfaces defining the groove, and the conveyor is operable by the driver. Advantageously, a continuous groove with an elongate polishing zone can be provided. Optionally, a moisturizing device can thus easily be provided to reconstitute or to moisturize the MR fluid.

The apparatus 100 includes a driver configured to provide relative motion between the at least one carrier and the edge of the article in a second direction substantially transverse to the first direction for polishing the edge of the article in the at least one polishing zone. The relative motion can be contributed by the driver providing a rotational motion B of the carrier about an axis in the first direction 109 that contributes to a tangential velocity at the groove relative to article. Alternatively, the relative motion can be contributed by the driver providing a translational relative motion C between the carrier 103 and the article 200 in a direction substantially transverse to the first direction 109. Yet alternatively, the relative motion may be a combination of both a rotational motion and a translation motion provided by the driver. The relative motion may further be a reciprocating motion, that is, alternating between two opposite directions substantially transverse to the first direction 109.

The magnetic field generator may be one magnet as shown in FIG. 1. Alternatively, as shown in FIG. 3*b*, the magnetic field generator may be a set of first and second permanent magnets that provide the first and second opposing surfaces respectively. The magnetic field generator may also be a plurality of magnets arranged along the groove, as in the embodiment of FIG. 13 or FIG. 14. The magnetic field generator is configured to provide the magnetic field throughout the groove such that in operation the MR fluid is stiffened throughout the groove. Advantageously, the groove is configured to retain substantially all of the MR fluid disposed therein such that it is not necessary to provide a sub-system for delivering the MR fluid to the carrier and for collecting the MR fluid from the carrier during operation. This hugely simplifies the apparatus as well as enabling easy scaling-up of the apparatus to enable a longer length of the edge to be polished simultaneously. As the MR fluid is substantially retained on the carrier throughout the polishing operation, a restoring tool may be provided to shape the MR fluid so that as the MR fluid is brought into the polishing zone, there is a desired amount of interface between the MR fluid and the edge to be polished.

Also disclosed is a method for polishing an edge of an article, the method involving providing at least one carrier including first and second opposing surfaces defining a groove, the first and second opposing surfaces being spaced apart in a first direction to receive the edge; and a magnetic field generator configured to provide a magnetic field in the groove to stiffen MR fluid disposed in the groove to provide at least one polishing zone; receiving the edge in the polishing zone; and driving relative motion between the at least one carrier and the edge in a second direction substantially transverse to the first direction. The method may further include stiffening the MR fluid throughout the groove. The method may also include retaining substantially all of the MR fluid disposed in the groove. The method may inviolve simultaneously receiving different parts of the edge in the groove. The method may further include rotating immediately adjacent ones of the carriers in different directions.

The described embodiments should not be construed as limitative. For example, instead of water as the carrier fluid, other types of carrier fluids such as oil may be used. Further, other suitable magnets may be employed, not just the Nd—Fe—B permanent magnet. Indeed, any type of permanent magnets such as rare earth permanent magnets and above may be used to produce relatively strong magnetic fields to produce sufficient stiffness in the MR fluid 110 for rapid removal of materials. Although certain features are explained in relation to one embodiment, it should be appreciated that those features may also be applicable to the other embodiments.

Having now fully described various embodiments of the proposed method and apparatus, it should be apparent to one of ordinary skill in the art that many modifications can be made hereto without departing from the scope as claimed.

What is claimed is:

1. An apparatus for polishing an edge of an article using a magnetorheological (MR) fluid, the apparatus comprising:

at least one carrier including:

first and second opposing surfaces defining a groove, the first and second opposing surfaces being spaced apart along a first direction to receive the edge; and a magnetic field generator configured to provide a magnetic field in the groove, wherein in operation the MR fluid is disposed in the groove and stiffens in response to the magnetic field to provide at least one polishing zone; and a driver configured to provide a relative motion between the at least one carrier and the edge of the article in a second direction substantially transverse to the first direction for polishing the edge of the article in the at least one polishing zone, wherein the relative motion further comprises a reciprocating motion.

2. The apparatus according to claim 1, wherein the magnetic field generator further comprises first and second permanent magnets providing the first and second opposing surfaces respectively.

3. The apparatus according to claim 1, wherein the magnetic field generator is configured to provide the magnetic field throughout the groove such that the MR fluid is stiffened throughout the groove.

4. The apparatus according to claim 3, wherein the groove is configured to retain substantially all of the MR fluid disposed therein.

5. The apparatus according to claim 1, wherein the groove is annular and wherein the groove is characterized by an axis of rotational symmetry parallel to the first direction.

6. The apparatus according to claim 1, wherein the groove extends substantially parallel to the second direction.

7. The apparatus according to claim 1, wherein the relative motion further comprises a rotational motion of the at least one carrier.

8. The apparatus according to claim 1, wherein a plurality of carriers of the at least one carrier is aligned substantially parallel to the second direction to simultaneously provide at least one polishing zone.

9. The apparatus according to claim 8, wherein each one of the at least one carrier is rotatable about an axis parallel to the first direction.

10. The apparatus according to claim 9, wherein immediately adjacent ones of the carriers are rotatable in different directions.

11. The apparatus according to claim 1, further comprising a restoring tool configured to shape the MR fluid.

12. The apparatus according to claim 1, wherein the at least one carrier further comprises a conveyor configured to provide the first and second opposing surfaces and wherein the conveyor is operable by the driver.

13. The apparatus according to claim 12, wherein the magnetic generator further comprises a plurality of magnets arranged equidistantly along the conveyor.

14. The apparatus according to claim 12, further comprising a moisturizing device configured to moisturize the MR fluid.

15. A method for polishing an edge of an article, the method comprising:

providing at least one carrier including:

first and second opposing surfaces defining a groove, the first and second opposing surfaces being spaced apart in a first direction to receive the edge; and a magnetic field generator configured to provide a magnetic field in the groove to stiffen magnetorheological (MR) fluid disposed in the groove to provide at least one polishing zone;

receiving the edge in the polishing zone; and driving a relative motion between the at least one carrier and the edge in a second direction substantially transverse to the first direction, wherein the relative motion further comprises a reciprocating motion.

16. The method according to claim 15, further comprising stiffening the MR fluid throughout the groove.

17. The method according to claim 16, further comprising retaining substantially all of the MR fluid disposed in the groove.

18. The method according to claim 15, further comprising simultaneously receiving different parts of the edge in the groove.

19. The method according to claim 18, further comprising rotating immediately adjacent ones of the carriers in different directions.

* * * * *